US011612225B2

(12) United States Patent
Schwartz et al.

(10) Patent No.: US 11,612,225 B2
(45) Date of Patent: Mar. 28, 2023

(54) SECURING BEACH NET

(71) Applicants: Nicholas Schwartz, Tacoma, WA (US); RaeJeana Schwartz, Tacoma, WA (US)

(72) Inventors: Nicholas Schwartz, Tacoma, WA (US); RaeJeana Schwartz, Tacoma, WA (US)

( * ) Notice: Subject to any disclaimer, the term of this patent is extended or adjusted under 35 U.S.C. 154(b) by 999 days.

(21) Appl. No.: 16/402,717

(22) Filed: May 3, 2019

(65) Prior Publication Data

US 2019/0335866 A1 Nov. 7, 2019

Related U.S. Application Data

(60) Provisional application No. 62/666,408, filed on May 3, 2018.

(51) Int. Cl.

| | |
|---|---|
| ***A45C 13/36*** | (2006.01) |
| ***A45C 3/00*** | (2006.01) |
| ***A45C 13/10*** | (2006.01) |

(52) U.S. Cl.

CPC ..... *A45C 3/001* (2013.01); *A45C 13/103* (2013.01); *A45C 13/36* (2013.01); *A45C 2003/002* (2013.01)

(58) Field of Classification Search

CPC ..... A45C 13/36; A45C 13/103; A45C 2003/002; A45C 3/001

USPC ..... 190/1; 5/417; 383/117, 118

See application file for complete search history.

(56) References Cited

U.S. PATENT DOCUMENTS

| | | | | |
|---|---|---|---|---|
| 2,264,471 | A | 12/1941 | Glenn | |
| 3,226,737 | A | 1/1966 | Rote | |
| 3,987,592 | A * | 10/1976 | Herminghaus | B29C 66/435 428/192 |
| 4,654,906 | A | 4/1987 | Roberts | |
| 5,018,230 | A | 5/1991 | Steberger | |
| 5,082,707 | A | 1/1992 | Fazio | |
| 5,441,789 | A | 8/1995 | Walker | |
| 5,467,487 | A | 11/1995 | Sicard | |
| 5,629,071 | A | 5/1997 | Feldman | |
| 5,666,679 | A | 9/1997 | Ruddy | |
| 5,729,846 | A | 3/1998 | Sullivan | |
| 5,870,785 | A | 2/1999 | Hoorens | |
| 5,895,118 | A | 4/1999 | Hensley | |
| 6,058,530 | A | 5/2000 | Wheeler | |
| 6,276,828 | B1 | 8/2001 | Otley et al. | |
| 6,742,203 | B2 | 6/2004 | Reynolds | |
| 6,754,919 | B2 | 6/2004 | Leaphart, Jr. et al. | |
| 6,821,600 | B1 * | 11/2004 | Henson | B32B 3/06 383/14 |
| 7,972,984 | B2 | 7/2011 | Knightley et al. | |
| 8,327,476 | B1 | 12/2012 | Paratore | |
| 8,950,023 | B2 | 2/2015 | Jacobsen et al. | |
| 2001/0014985 | A1 | 8/2001 | Bartosik | |
| 2003/0019034 | A1 * | 1/2003 | Hyduk | A47G 9/062 135/118 |
| 2005/0004355 | A1 * | 1/2005 | Olsen | C07K 14/4723 435/5 |

(Continued)

*Primary Examiner* — Sue A Weaver

(74) *Attorney, Agent, or Firm* — Kelly G. Swartz; Widerman Malek, PL

(57) ABSTRACT

A securing net for personal items including a mesh material having a perimeter, a border material secured to an entirety of the perimeter of the mesh material, and a plurality of securing points carried by the border material.

17 Claims, 9 Drawing Sheets

(56) References Cited

U.S. PATENT DOCUMENTS

| | | | | |
|---|---|---|---|---|
| 2005/0005355 | A1* | 1/2005 | Marks | A47G 9/062<br>5/417 |
| 2005/0077135 | A1* | 4/2005 | Drew | A45C 13/00<br>190/110 |
| 2006/0062493 | A1 | 3/2006 | Chu | |
| 2007/0017027 | A1 | 1/2007 | Bowman et al. | |
| 2007/0127849 | A1 | 6/2007 | Lakis | |
| 2008/0127414 | A1 | 6/2008 | Allen | |
| 2008/0163443 | A1 | 7/2008 | Brown | |
| 2008/0172788 | A1* | 7/2008 | Rosen | A47G 9/064<br>5/417 |
| 2010/0066118 | A1* | 3/2010 | Miller | B60J 1/2011<br>296/107.11 |
| 2011/0305867 | A1 | 12/2011 | Lee et al. | |
| 2012/0124739 | A1 | 5/2012 | Crowne et al. | |
| 2013/0125307 | A1 | 5/2013 | Margalit | |
| 2015/0143632 | A1 | 5/2015 | Obrentz | |

* cited by examiner

SECURING BEACH NET

RELATED APPLICATIONS

This application claims priority under 35 U.S.C. § 119(e) of U.S. Provisional Patent Application Ser. No. 62/666,408 filed on May 3, 2018 and titled SECURING BEACH NET. The content of this application is incorporated herein by reference.

FIELD OF THE INVENTION

The present invention relates to systems for securing personal belongings. More specifically, the present invention relates to a net adapted to secure personal belongings.

BACKGROUND OF THE INVENTION

Attending the beach for swimming, sun bathing and similar pastimes is a popular recreational activity, especially in the warmer climates. Participants often have a need to sit, lie or otherwise recline on the sand. Often, Participants also bring a number of personal possessions with them to the beach, many of which may be light weight or small. Either of which can be blown away with even a light wind or difficult to locate as they may easily be covered by sand. There exists a need for a device that may be used as a beach blanket while also retaining personal items.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a securing net for personal items including a mesh material having a perimeter, a border material secured to an entirety of the perimeter of the mesh material, and a plurality of securing points carried by the border material.

The securing net may include a plurality of stakes wherein each of the plurality of stakes is adapted to be received by one of the plurality of securing points and secured to the ground.

The securing net may include a zipper carried by the mesh material and operable to gain access to a location between the mesh material and the ground.

The border material may include an elastic material.

The mesh material may include an elastic material.

The mesh material may include a plurality of elastic cords.

The mesh material may further include a first plurality of parallel elastic cords and a second plurality of parallel elastic cords perpendicular to the first plurality of parallel elastic cords.

The mesh material may be adapted to stretch at least fifty percent of its length in a longitudinal direction.

The mesh material may be adapted to stretch fifty percent of its width in a transverse direction.

At least a portion of the border material may be adapted to stretch fifty percent of its length in a longitudinal direction.

The mesh material may be non-absorbent.

The securing net may include an interior border material member secured to a first location on the border material and to a second location on an opposing location of the border material at a location other than at an edge of the mesh material.

The interior border material member may extend from a first midpoint of a first portion of the border material to a second midpoint of a second portion of the border material, which opposes the first midpoint of the first portion of the border material.

The securing may include a mat secured to the border material. The mat may be non-absorbent.

An embodiment of the securing net for personal items may include a first mesh material having a first perimeter; a first border material secured to an entirety of the first perimeter of the first mesh material; a second mesh material having at least a first edge secured to the first border material; a third mesh material having at least a second edge secured to the first border material; a first zipper half secured to at least a third edge of the second mesh material; a second zipper half secured to at least a fourth edge of the third mesh material and adapted to mate with the first zipper half; a plurality of securing points secured to the first border material; and a mat secured to at least a portion of the first border material.

The unstretched perimeter of the mesh material may be equal to or less than the perimeter of the mat.

The securing net may include a plurality of stakes wherein each of the plurality of stakes is adapted to be received by one of the first plurality of securing points and secured to the ground.

The first and second zipper halves may be operable to gain access to a location between the second and third mesh materials and the mat.

The securing net for personal items may include an elastic, non-absorbent first mesh material adapted to stretch fifty percent of its length in a longitudinal direction, to stretch fifty percent of its width in a transverse direction, and having a perimeter, the mesh material may include: a first plurality of parallel elastic cords, and a second plurality of parallel elastic cords perpendicular to the first plurality of parallel elastic cords; an elastic, non-absorbent border material adapted to stretch fifty percent of its length in a longitudinal direction and secured to an entirety of the perimeter of the mesh material; a plurality of securing points secured to the border material; a plurality of stakes wherein each of the plurality of stakes is adapted to be received by one of the plurality of securing points and secured to the ground; a non-absorbent mat having a perimeter wherein at least a portion of the perimeter is secured to the border material; a zipper carried by the mesh material and operable to gain access to a location between the mesh material and the mat; and an interior border material member secured to a first location at a first midpoint of a first side on the border material and to a second location at a second midpoint of a second side on the border material, opposing the first side at a location other than at an edge of the mesh material.

DETAILED DESCRIPTION OF THE INVENTION

Figure 1:
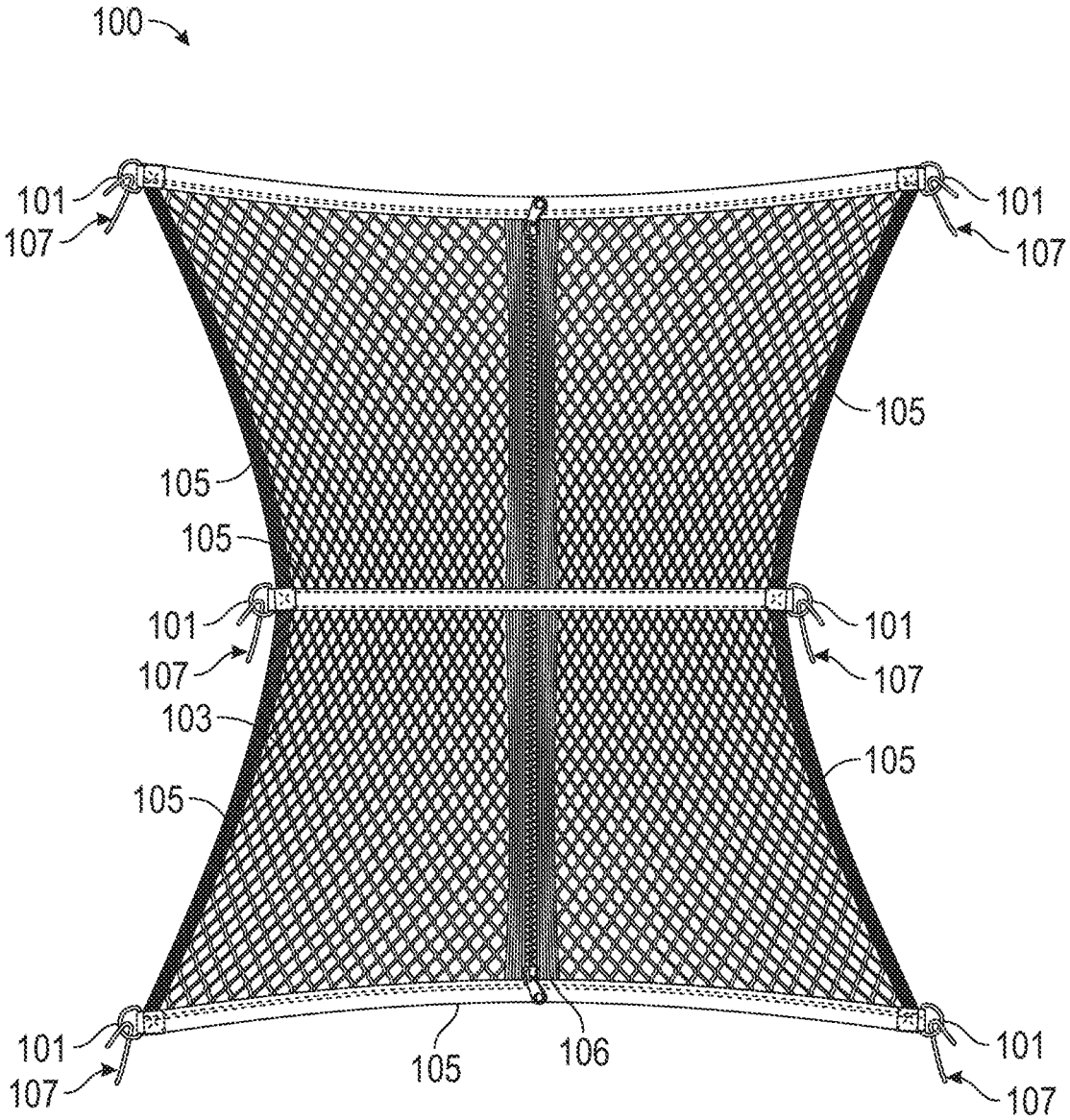
FIG. 1 is a perspective view of the securing net according to an embodiment of the invention.
Figure 2:
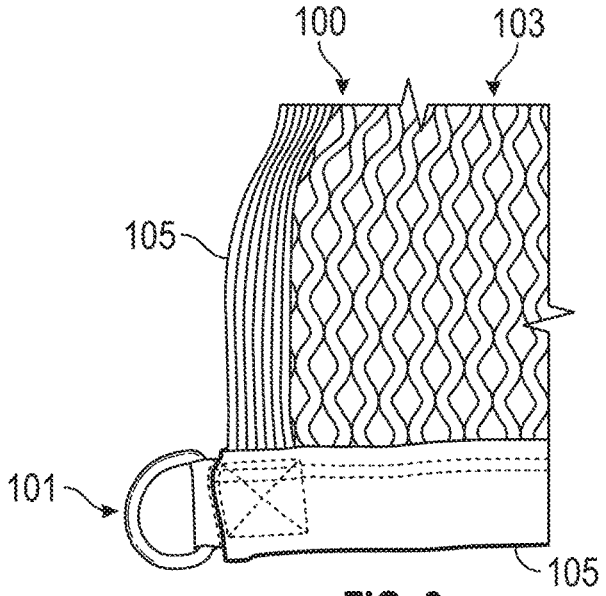
FIG. 2 is a top plan view of a securing point of the securing net of FIG. 1.
Figure 3:
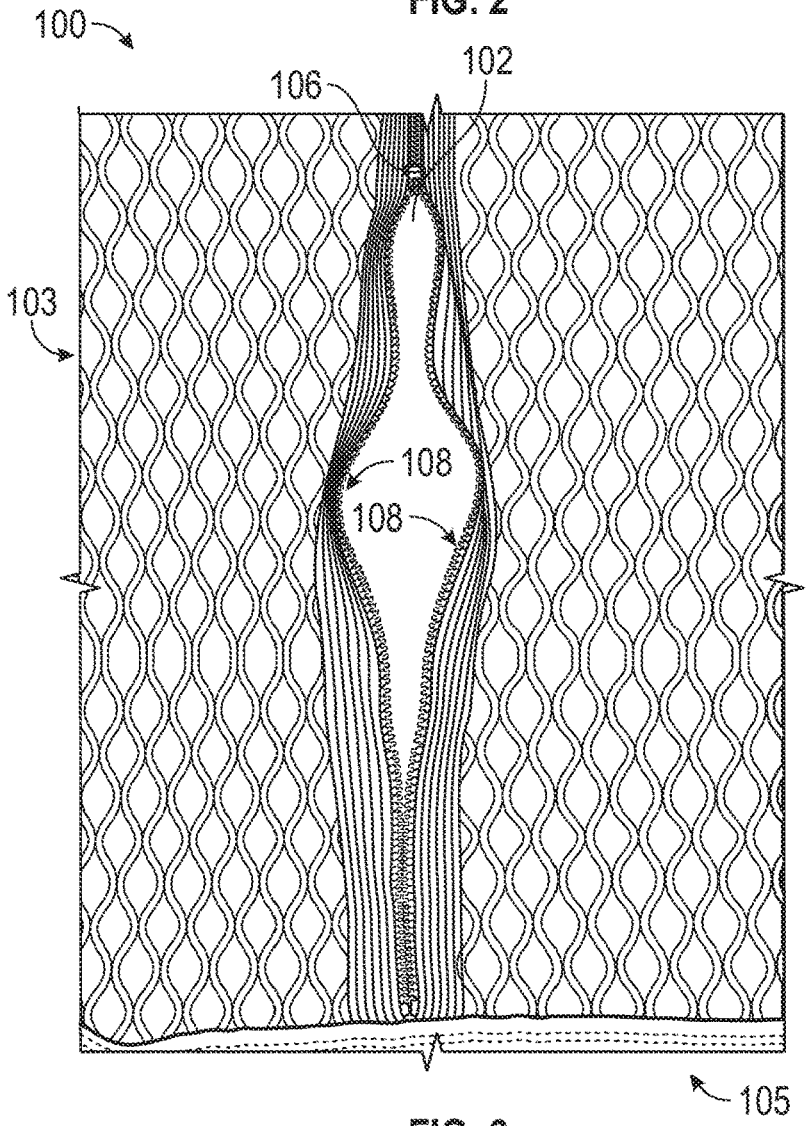
FIG. 3 is a top plan view of an opening of the securing net of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a securing net 100. The securing net 100 may include a mesh material 103, a border material 105, and a plurality of securing points 101. In one embodiment, the securing net 100 may additionally include a mat 104. Personal items may be place under the mesh material 103 and the mesh material 103 may secure the personal items.

The mesh material 103 may be constructed from a flexible, elastic material, which may be formed from elastic rubber, or the like. The mesh material 103 may be non-elastic but may include an elastic cord or may include be secured to an elastic border material 105. The mesh material 103 may include rubber, polyester, nylon, HDPE, PE, PP, or the like. The mesh material 103 may be adapted to stretch in both a longitudinal and transverse direction. In one embodiment, the mesh material 103 may be adapted to stretch approximately 50% of its length in both a longitudinal and transverse direction. In other embodiments, the mesh material 103 may be adapted to stretch 50% or less in both a longitudinal and transverse direction. The mesh material 103 may be non-absorbent or hydrophobic.

The mesh of the mesh material 103 may be formed from a plurality of evenly spaced strands, elastic cords, or the like. Each of the evenly spaced strands, cords, or the like may be elastic. There may be a first plurality of evenly spaced strands, cords, or the like, wherein each of the strands, cords, or the like in the first plurality of evenly spaced strands, cords, or the like are positioned parallel to the other strands, cords, or the like in the first plurality of evenly spaced strands, cords, or the like. There may be a second plurality of evenly spaced strands, cords, or the like, wherein each of the strands, cords, or the like in the second plurality of evenly spaced strands, cords, or the like are positioned parallel to the other strands, cords, or the like in the second plurality of evenly spaced strands, cords, or the like. The first and second pluralities of evenly spaced strands, cords, or the like may be joined together perpendicularly to one another. In another embodiment, there may be a plurality of strands, cords, or the like extending from a first side of the mesh material 103 to an opposing second side of the mesh material 103. Each of the plurality of strands, cords, or the like may be secured at intervals to another, adjacent of the plurality of strands, cords, or the like. The attachment may alternate between attachment to a strand, cord, or the like located adjacently on a first side of the strand, cord, or the like and to a strand, cord, or the like located adjacently on a second side, which opposes the first side, of the strand, cord, or the like.

The mesh material 103 may have a border material 105 around one or more edges. The border material 105 may be flexible and may include an elastic material. In one embodiment, the border material 105 may be secured to an entirety of the perimeter of the mesh material 103. The mesh material 103 may have four sides and may have elastic border materials 105 on all four sides. The border material 105 may be adapted to stretch fifty percent in a longitudinal direction. The mesh material 103 may have a border material 105 extending transverse the mesh material 103 at a location other than an edge of the mesh material 103. Such a border material may be referred to as an interior border material 105. In one embodiment, a border material 105 may extend transverse the mesh material 103 from the midpoint of a first side to the midpoint of a second, opposing side. This may be an interior border material 105 and may be referred to as a center border material 105. Interior border materials 105, including the center border material 105, may be secured to a mat 104 either fixedly or removably and may be elastic or non-elastic. In embodiments in which interior border materials 105 are removably secured to the mesh material 103, the mesh material 103 have a securing member affixed thereto, which may be adapted to secure to a mating securing member located on the removable interior border material 105.

One or more border materials 105 may include a flexible band. In one embodiment, one or more flexible bands may be located along an entirety of the perimeter of the mesh material 103. In one embodiment, the center border material may include a flexible band configured to extend along a centerline of the mesh material 103. In such an embodiment, the center border material 105 may be removably secured to the mesh material 103 with a fastener such as, but not limited to, a zipper, button, snap, hook and loop, or the like. In such an embodiment, the center border material 105 may have at least two securing points 101, one located at each opposing end of the center border material 105 and adapted to receive a stake, which may secure the center border material 105 to the ground.

Securing points 101 may be secured directly to or carried by the border material 105 and be adapted to secure the mesh material 103 in a stretched configuration or to immobilize the mesh material 103. In one embodiment, the securing points 101 may be d-rings, loops, grommets, or the like. In such an embodiment, the securing net 100 may include a plurality of stakes 107. Each of the plurality of stakes may be carried or received by a securing point 101 and utilized to secure the mesh material 103 to the ground or similar surface. In one embodiment, the securing points 101 may be envelopes, bags, containers, or the like. The securing point 101 may be adapted to hold sand, rocks, or another weighted material, which would secure the securing net 100 to the ground. The securing points 101 may be located at each vertex of the mesh material 103. Securing points 101 may be located along sides of the mesh material 103. In one embodiment, securing points 101 may be located at the midpoint of one or more sides of the mesh material 103. One or more securing points 101 may be carried by a border material 105, including, but not limited to, a center border material 105. Each of the securing points 101 may secure to the border material 105 and extend perpendicularly from the border material 105. Alternatively, each of the securing points 101, in particular the securing points 101 at vertices, may secure to the border material 105 and extend away from the mesh material 103 at an angle to the border material 105. The securing point 101 may be positioned about a vertex of the border material 105 and extend away from the mesh material 103 parallel to a line bisecting the vertex. Each securing point 101 may be carried by the border material 105. Each securing point 101 may form an aperture in the border material 105. Similarly, securing points 101 may be secured to the mat 104 and positioned to align with securing points 101 secured to the mesh material 103.

In one embodiment, a non-flexible center border material 105 may be fixedly secured to the mat 104 along a centerline of the mat 105. On a first side of the centerline, the border materials adjacent the center border material 105 may be fixedly secured to the mesh material 103 while the border material 105 on the first side opposing the center border material 105 may be unsecured to or removably secured to the mat 103 to create a pocket configuration. On a second side of the centerline, the border material 105 may be flexible and unsecured to or removably secured to the mat 103. Such a configuration may allow the mesh material 103 to be stretched beyond a perimeter of the mat 104 and secured to the ground using stakes or the like.

The mesh material 103 may have no opening or may have one or more openings 102 in addition to the openings inherently apparent due to the nature of mesh construction. The opening 102 may be positioned parallel to a side or border material 105 of the mesh material 103. A user may utilize the opening 102 to access personal belongings stored beneath the mesh material 103. In embodiments having a center border material 105, there may be an opening 102 on either or both sides of the center border material 105. The opening 102 may be located along a centerline of the mesh material 103. The opening 102 may be positioned parallel to a side of the mesh material 103. The opening 102 may be secured in a closed configuration with an opening fastener 106, which may be, but is not limited to, a zipper, button, snap, hook and loop, or the like.

Each portion of mesh material 103 may have a perimeter. In one embodiment, the opening 102 may be formed between two portions of mesh material 103. Each of the two portions of mesh material 103 may carry a zipper half 108, which may be secured to an edge of the respective mesh material 103 portions. The zipper halves 108 may be adapted and positioned to mate with one another. The zipper 106 may be operable to gain access to a location between the mesh material 103 and the ground when the securing net 100 is secured to the ground with stakes 107. The zipper 106 may be operable to gain access to a location between the mesh material 103 and the mat 104 when the securing net 100 is secured to a mat 104.

In one embodiment, a mat 104 may be securable to the mesh material 103 or the border material 105. The mat 104 may be a piece of material, which may be non-absorbent. In one embodiment, the mat 104 may be a two-ply material, such as, but not limited to, agricultural fabric, double layer high-density polyethylene (HDPE), or the like. In one embodiment, the mat 104 may include polyester, PVC, nylon parachute nylon, cotton, microfiber, polypropylene, or the like. The mesh material 103 may cover substantially the entirety of the area of the mat 104 and may have a perimeter with dimensions equal to the dimensions of the perimeter of the mat 104. In another embodiment, the mesh material 103 may be sized to cover a portion of the mat 104 less than the entirety. In one embodiment, the mesh material 103 may be sized to cover essentially half of the mat 104.

Figure 4A:
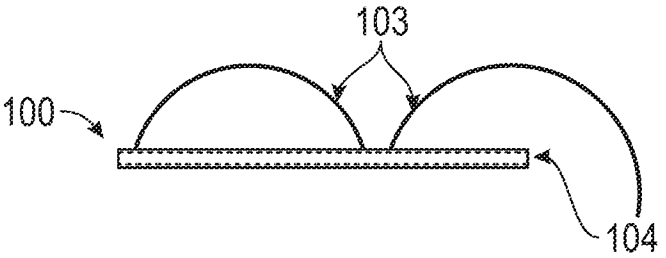
FIG. 4*a* is a side elevation view of a possible configuration of the securing net according to an embodiment of the invention.
Figure 4B:
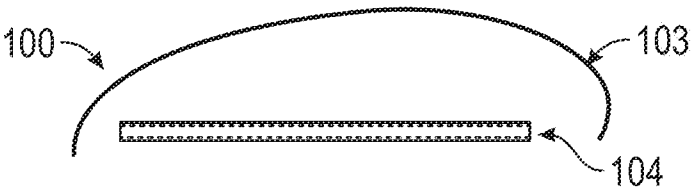
FIG. 4*b* is a side elevation view of a possible configuration of the securing net according to an embodiment of the invention.
Figure 4C:
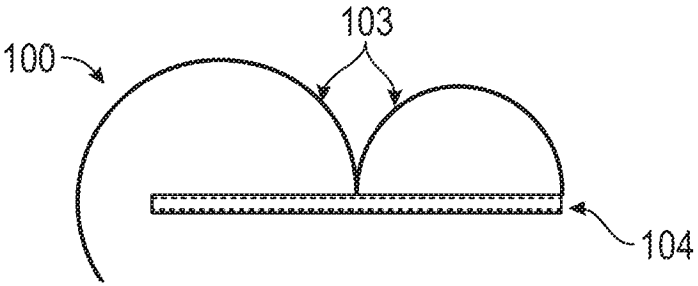
FIG. 4*c* is a side elevation view of a possible configuration of the securing net according to an embodiment of the invention.
Figure 4D:
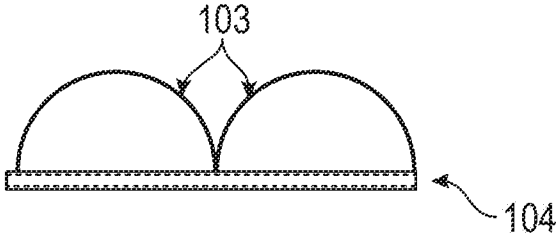
FIG. 4*d* is a side elevation view of a possible configuration of the securing net according to an embodiment of the invention.
Figure 4E:
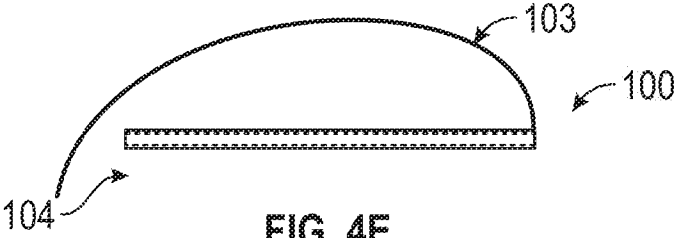
FIG. 4*e* is a side elevation view of a possible configuration of the securing net according to an embodiment of the invention.
Figure 4F:
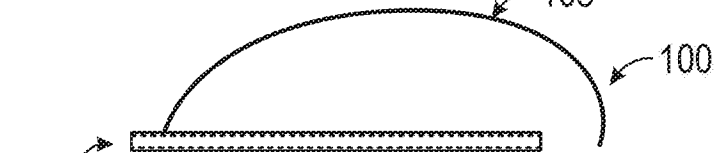
FIG. 4*f* is a side elevation view of a possible configuration of the securing net according to an embodiment of the invention.
Figure 4G:
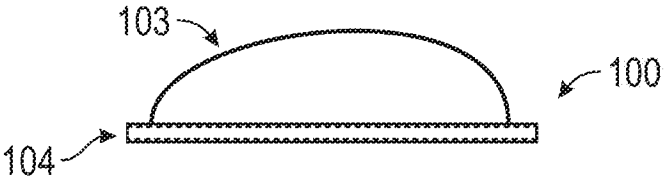
FIG. 4*g* is a side elevation view of a possible configuration of the securing net according to an embodiment of the invention.

The mesh material 103 may be fixedly secured to the mat 104 or removably secured. In embodiments in which the mesh material 103 or border material 105 is fixedly secured to the mat 104, the center border material 105 may be sewn to the mat 104. The center border material 105 may be sewn to the mat 104 along an entirety of the length of the center border material 105. In embodiments in which the mesh material 103 or border material 105 is removable secured to the mat 104, the mesh material 103 or border material 105 may be secured to the mat 104 with a fastener, such as, but not limited to, zippers, hooks and loops, buttons, snaps, or the like, which may be carried by the border material 105 or mesh material 103. The mesh material 103 or border material 105 may be fixedly secured to the mat 104 at some connection points and removably secured at others. The mesh material 103 or border material 105 may be secured, either fixedly or removably, along an entirety or portion of any side, at a midpoint, or along an entirety of a centerline. Removable and fixed attachments may be provided in any combination at these securing locations. In one embodiment, the securing net 100 may be rectangular. The mesh material 103 may be fixedly or removably secured to the mat 104 along a centerline traversing the mat 104 and removably secured to one or both opposing ends parallel to the centerline. FIGS. 4*a-g* depict some possible securement configurations. The securing mat 100 may be triangular, circular, or have any other perimeter shape.

Figure 5A:
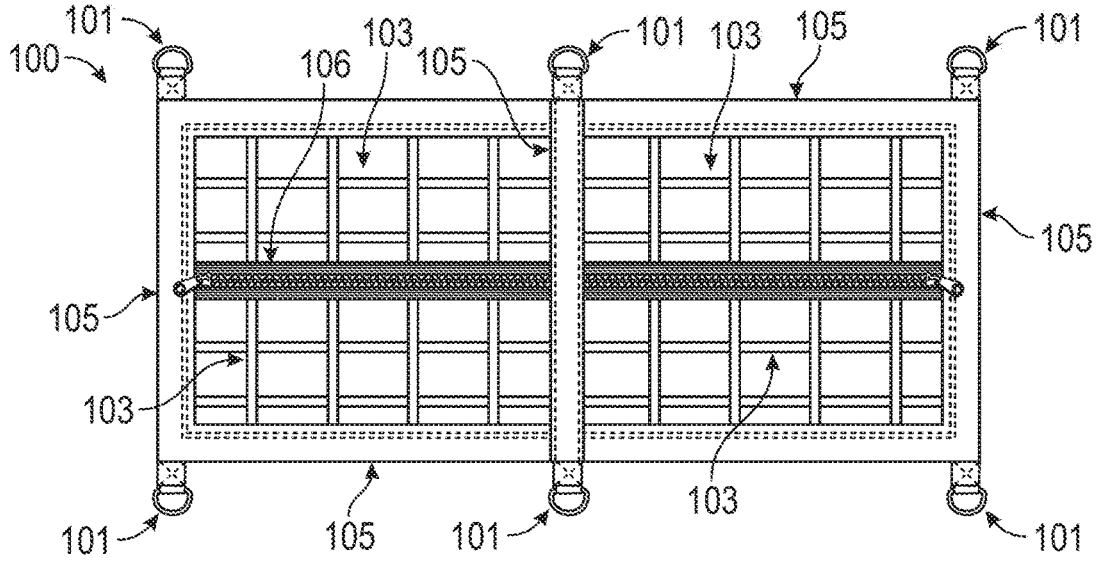
FIG. 5*a* is a top plan view of a possible configuration of the securing net according to an embodiment of the invention.
Figure 5B:
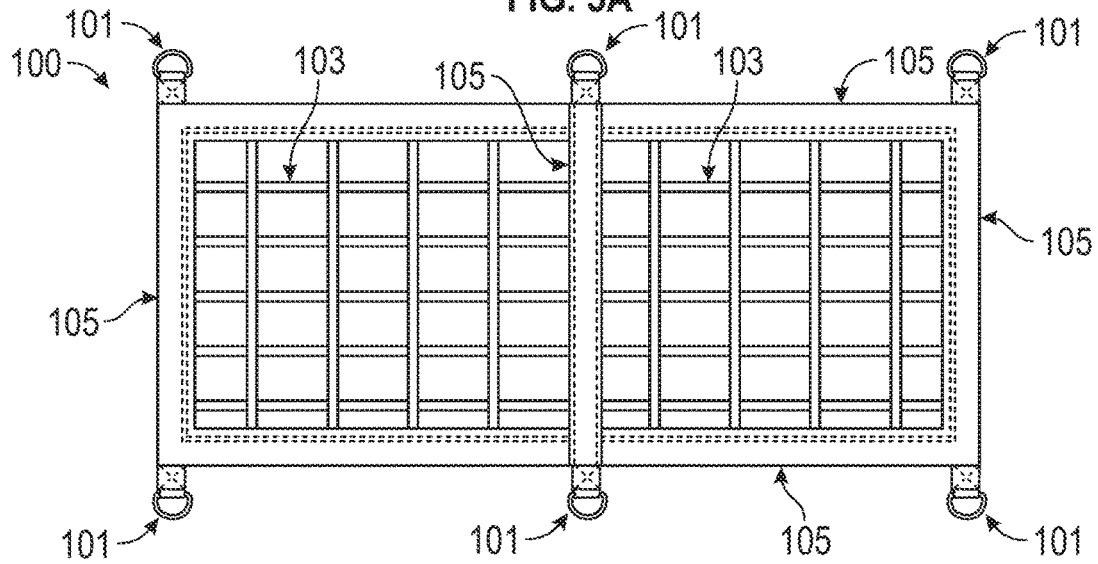
FIG. 5*b* is a top plan view of a possible configuration of the securing net according to an embodiment of the invention.
Figure 5C:
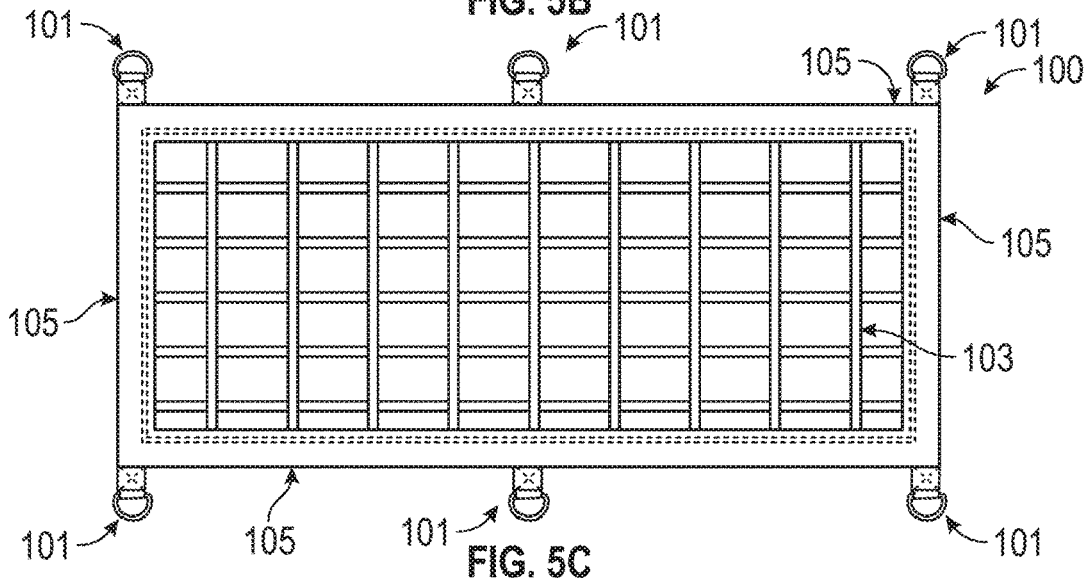
FIG. 5*c* is a top plan view of a possible configuration of the securing net according to an embodiment of the invention.
Figure 6:
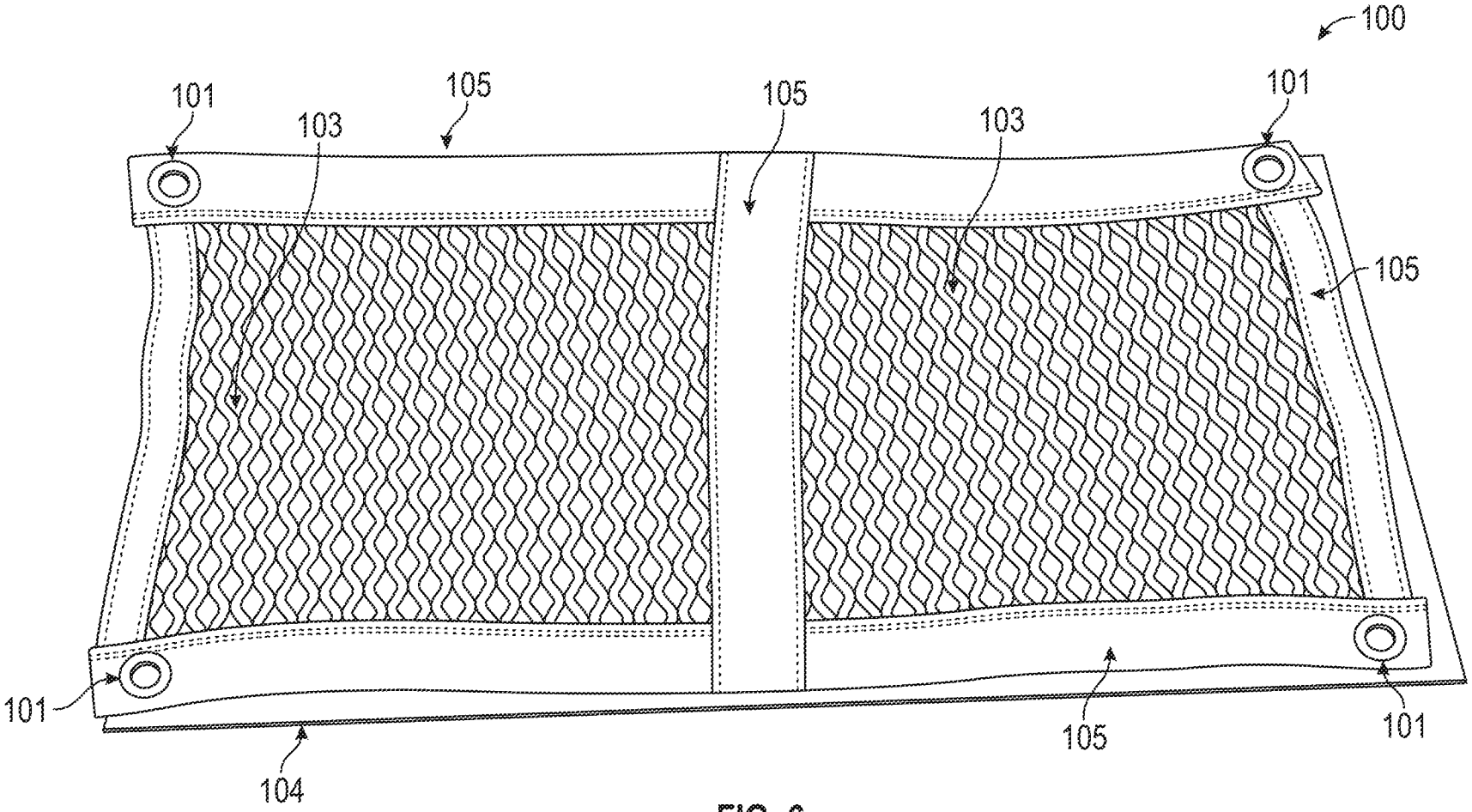
FIG. 6 is a top plan view of the securing net in accordance with an embodiment of the invention.
Figure 7:
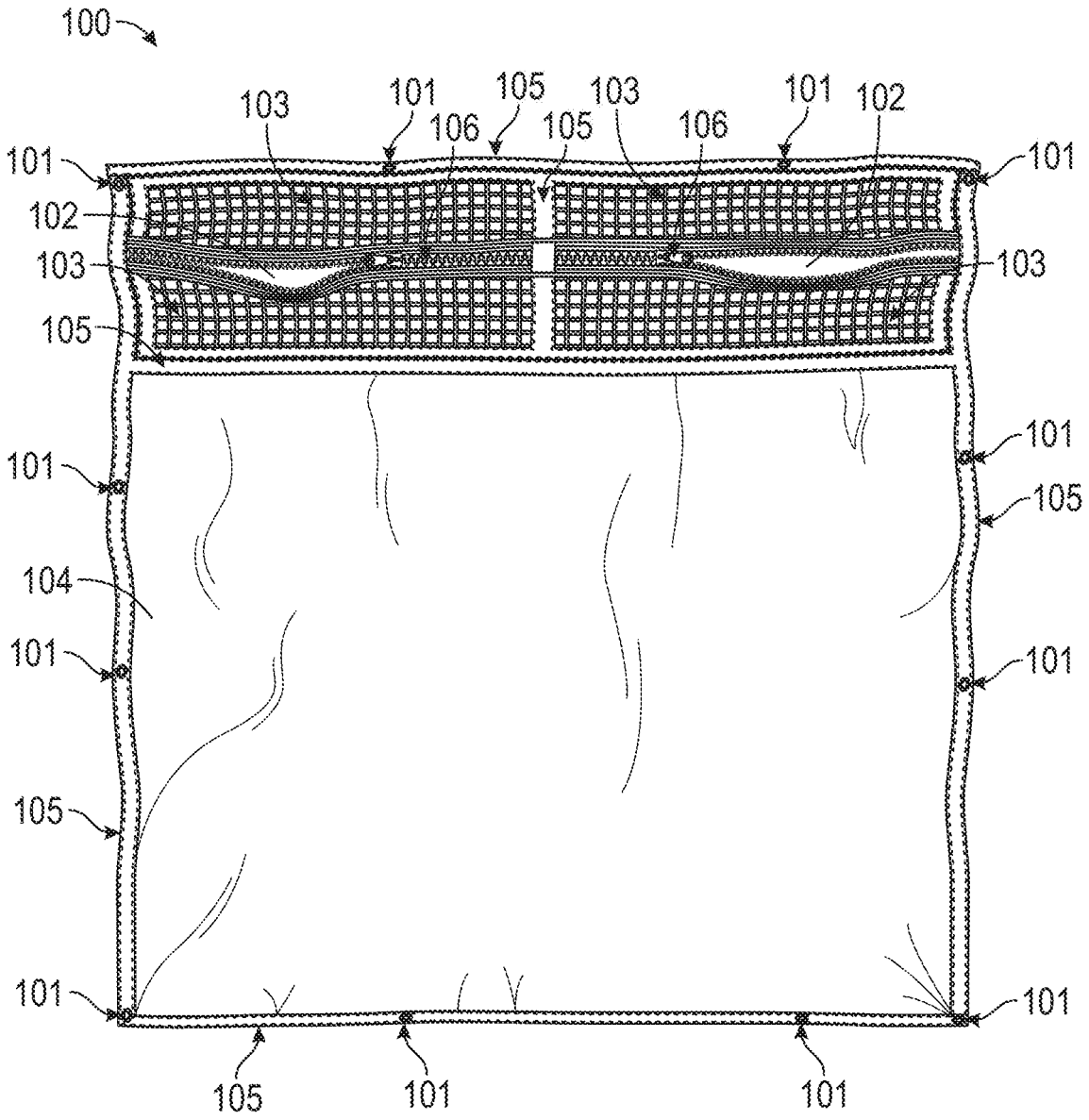
FIG. 7 is a top plan view of the securing net according to an embodiment of the invention.
Figure 8:
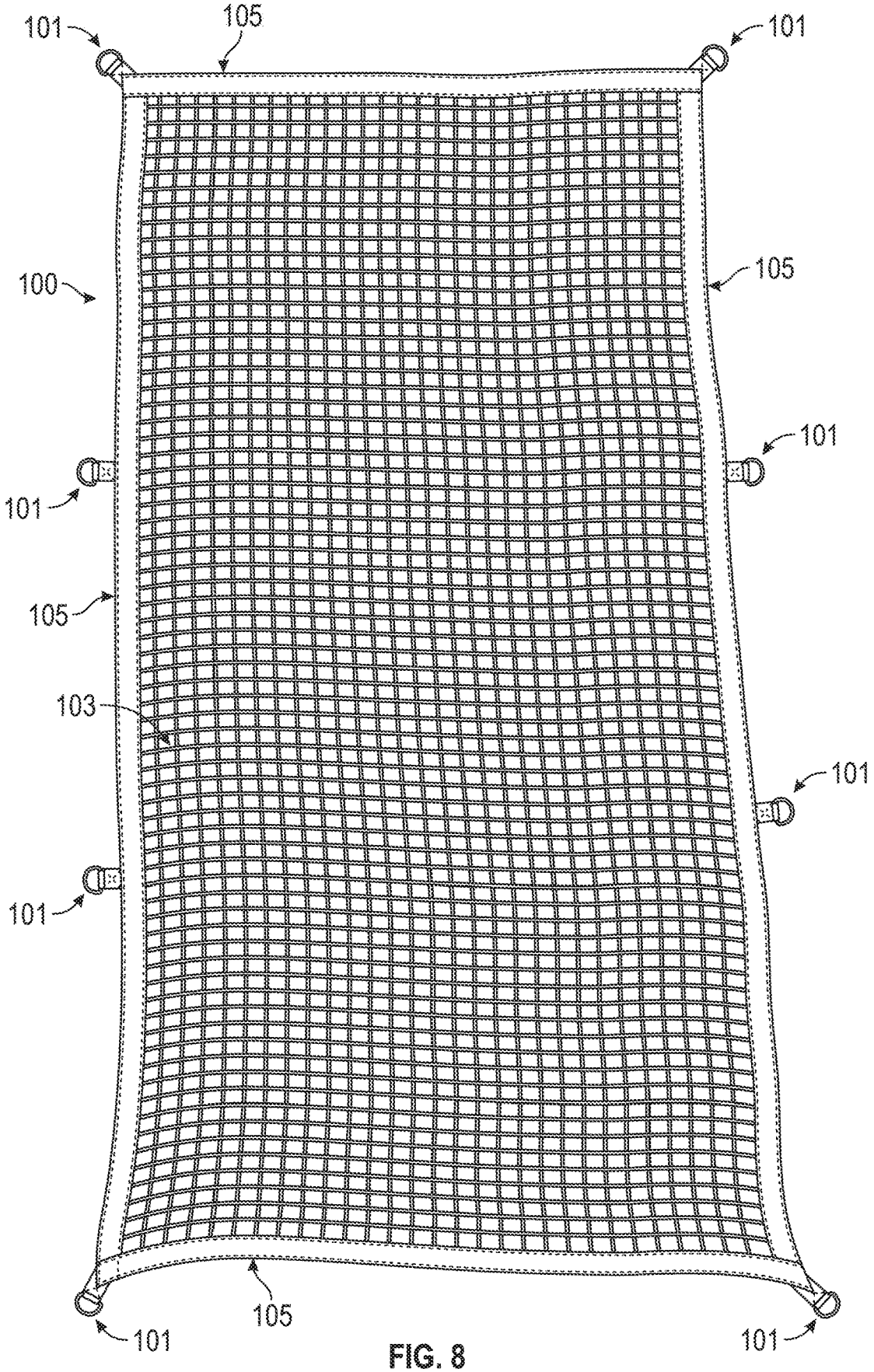
FIG. 8 is a top plan view of the securing net according to an embodiment of the invention.
Figure 9:
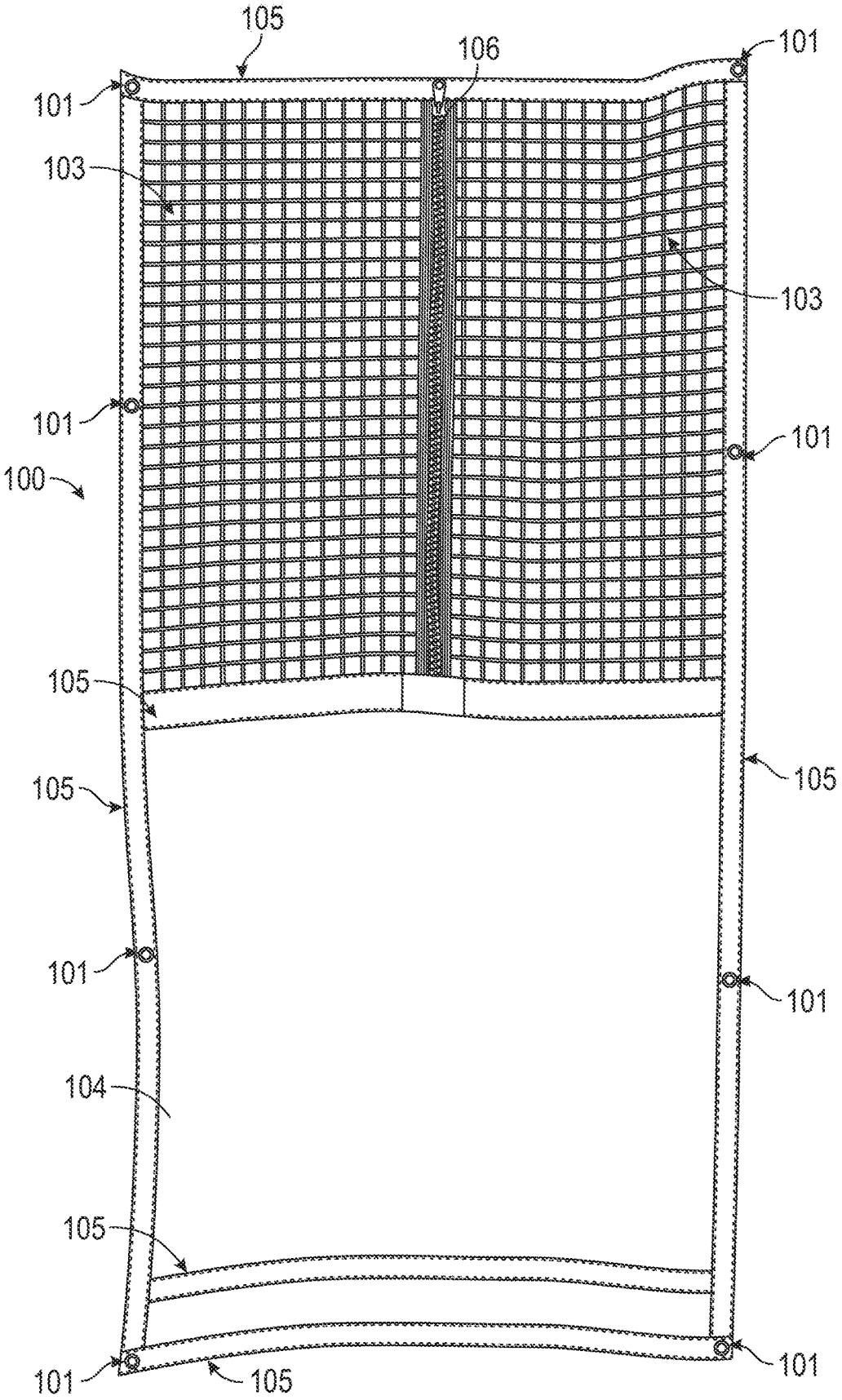
FIG. 9 is a top plan view of the securing net according to an embodiment of the invention.
Figure 10:
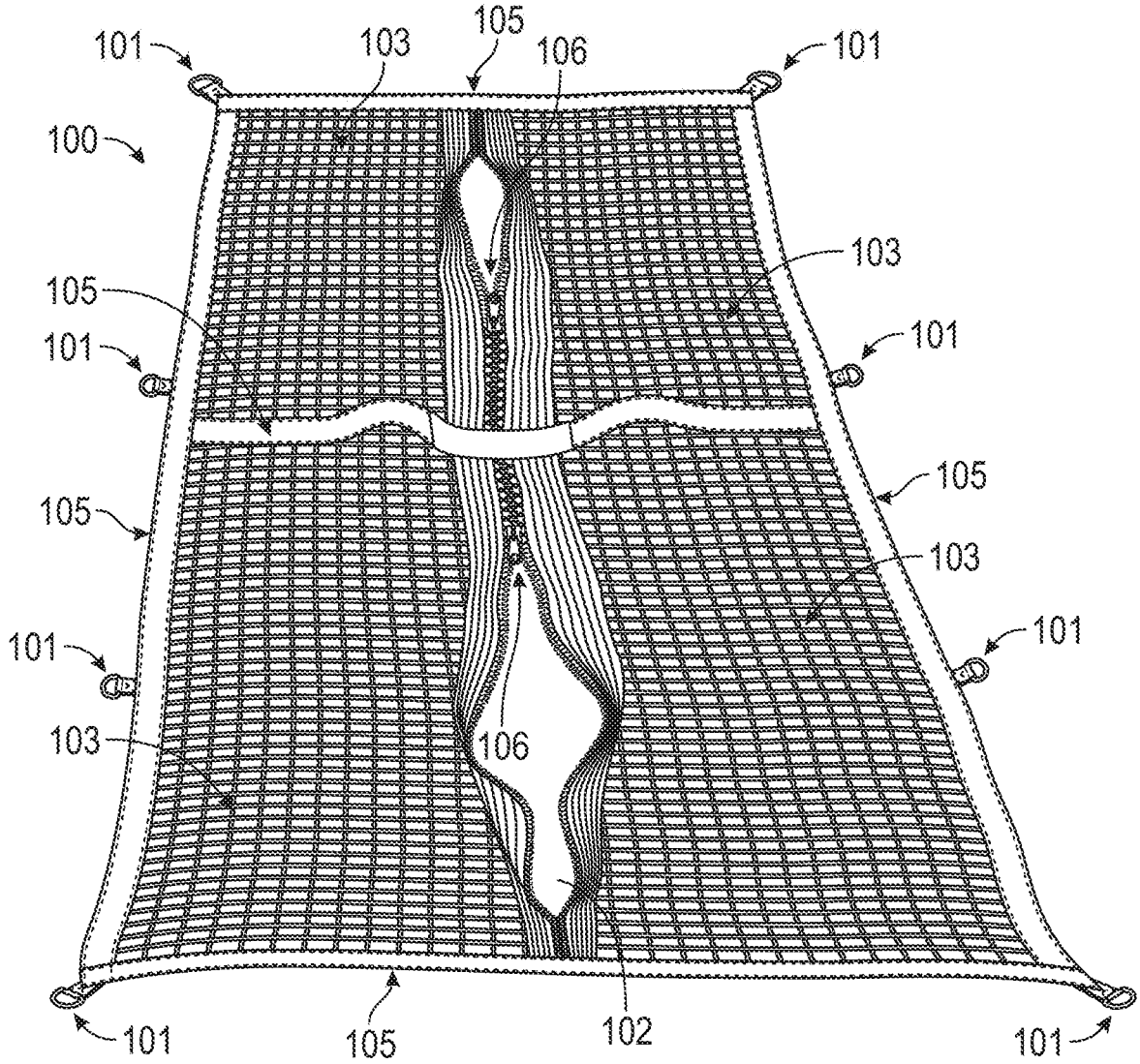
FIG. 10 is a top plan view of the securing net according to an embodiment of the invention.

The securing net 100 may have many different configurations as depicted at least in FIGS. 1, 5A, 5B, 5C, and 6-10. And combinations of these configurations are also possible.

In embodiments with an interior border material 105, whether or not the interior border material 105 is at a center point, there may be more than one mesh material 103 member. In such an embodiment, there may be two or more mesh material 103 members. In one possible embodiment, there may be a first side and a second side of the securing net 100, which may be divided by the interior border material 105. The first side may include a mesh material 103 secured the border material 105 around an entirety of the perimeter of the mesh material 103. The second side may also include a mesh material 103 secured to the border material 105 around an entirety of the perimeter of the mesh material 103 of the second side. The mesh material 103 of both the first side and second side may secure to the interior border material 105 on opposing sides of the interior border material 105.

In another embodiment, the first side may include a mesh material 103 secured the border material 105 around an entirety of the perimeter of the mesh material 103. The second side may also include a second mesh material 103 member and a third mesh material 103 member. One side of both the second and third mesh material 103 members may secure to the interior border material 105 on a side of the interior border material 105 opposing the side on which the mesh material 103 of the first side of the securing net 100 is attached. On adjacent sides of the second and third mesh material 103 members extending away from the interior border member 105, zipper halves may be secured to the mesh material 103 members. These zipper halves may be adapted to secure to one another and join the second and third mesh material 103 members together. The remaining edges of both the second and third mesh material 103 members may be secured to border material 105.

In yet another embodiment, both sides of the securing net 100 may be formed with zippers securing two mesh material 103 members to one another.

Each of these described configurations of the securing net 100 may be used in combination with a mat 104. The mat may have a perimeter equal to the perimeter of the outer border material 105 secured to the mesh material 103. In another embodiment, the perimeter of the mat 105 may be larger than the perimeter of the outer border material 105. This may allow a user to rest upon the mat 104 while the mat 104 is secured to the mesh material 103 or personal items are secured between the mat 104 and the mesh material 103.

The mat 104 may have securing points 101 located around a perimeter. In one embodiment, the securing points 101 may be d-rings, loops, grommets, or the like. In such an embodiment, a stake may be carried by the attachment point 101 and utilized to secure the mat 104 to the ground or similar surface. In one embodiment, the securing points 101 may be envelopes, bags, or the like adapted to hold sand, rocks, or another weighted material adapted to secure the securing mat 100 to the ground. The securing points 101 may be located at each vertex of the mat 104. Securing points 101 may be located along sides of the mat 104. In one embodiment, securing points 101 may be located at the midpoint of one or more sides of the mat 104.

The securing net 100 may have one or more handles or straps affixed thereto. The one or more handles or straps may be adapted to allow a user to transport the securing net 100 when not in use or may be used to transport personal property after use. The handles or straps may be made of rope, fabric, nylon, plastic, or the like. The securing net 100 may be adapted to be folded and stored in a storage bag when not in use. The storage bag may be a tote, drawstring bag, or the like.

The securing net 100 may have one or more accessories which may be secured, either removably or fixedly to the mesh material 103. The one or more accessories may include, but are not limited to, mesh pockets, dry bags, totes, or the like. The one or more accessories may be removably secured to the mesh material 103 using a fastener, including, but not limited to, a zipper, hook and loop, button, rivet, snap, or the like.

A plurality of securing nets 100 may be secured to one another using connectors located on the sides of the securing nets 100. Connectors may include, but are not limited to grommets, snaps, cords, hooks, ropes, or the like. Mating connectors may be located on opposing sides of the securing nets 100 to allow one securing net 100 to connect to another securing net 100.

In one embodiment, one or more securing nets 100 may be secured to a ring at a first side. The ring may be made from hard rubber, plastic, wood, or the like, and include one or more hooks. Each securing net 100 may have a fastener located along a first side and adapted to secure to at least one of the hooks of the ring. The ring may be positioned around a vertical pole and positionable at different heights of the pole using a pulley system. In such an embodiment, a second side of the securing net 100, which opposes the first side, may be secured to the ground using one or more stakes 107. A plurality of securing nets 100 may be joined together along edges of the securing nets between the first and second edges 100. Each of the plurality of securing nets 100 may be secured to both the ring and the ground so that raising the ring off the ground may create a tent, in which personal belongings may be stored. The securing nets 100 may also be utilized in a flat configuration in which they are secured to one another and the ring rests on the ground.

Each securing net 100 may be adapted to secure to one or more other securing nets 100 in an interchangeable relationship.

The securing net 100 may be beneficial to secure personal belongings in outdoor setting. Personal belongings may be placed on the ground and the mesh material 103 may be placed over the personal belongings. Using stakes or other securing members, the mesh material 103 may be fastened in place over the personal belongings. A single stake may be used to secure both a securing point on the mesh material 103 and a securing point on the mat 104. The securing net 100 may be adapted to have securing points 101 sized to receive the pole of a beach umbrella. In such an embodiment, the pole of the beach umbrella may be a stake and may be used to secure the mesh material 103 or the mat 104 to the ground. The securing net 100 may be adapted to have securing points 101 spaced apart from one another at a distance equal to the spacing of beach chair legs. The beach chair legs may be received by the securing points 101 and may be stakes. The beach chair legs may be used to secure the mesh material 103 or the mat 104 to the ground. The mesh material 103 may be a deterrent to prevent unauthorized individuals from accessing the personal belongings positioned beneath the mesh material 103. Additionally, the mesh material 103 may protect personal belongings from being carried away due to environmental factors, such as, but not limited to, wind or the like. In embodiments including a mat 104, personal belongings may be placed atop the mat 104 and the mesh material 103 may be placed over the personal belongings and secured to any combination of the mat 104, ground, or similar securement point to maintain the mesh material 103 in position covering the personal belongings.

By way of example, and not as a limitation, the securing net 100 may be used to protect personal items from theft or from being blown away by wind. The mat 104 may be placed over the ground to provide a dry, clean surface. The mesh material 103 may be placed over personal items and secured to the ground with stakes. When in a non-stretched configuration, the mesh material 103 may have a perimeter the same dimensions as the perimeter of the mat 104. When in a stretched configuration, the mesh material 103 may extend beyond the perimeter of the mat 104. The mesh material 103 may be used to cover or secure personal items while the items are left unattended at the beach, park, picnic area, or the like. The mesh material 103 may be used to prevent the wind from blowing away personal items at the beach, park, picnic area, or the like. Accessories to the securing net 100 may allow loose items to be carried by the securing net 100 or dry items to be contained in the securing net 100.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the description of the invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

That which is claimed is:

1. A securing net for personal items comprising:
a mesh material having a perimeter;
a border material secured to an entirety of the perimeter of the mesh material;
a plurality of securing points carried by the border material;
a plurality of stakes wherein each of the plurality of stakes is adapted to be received by one of the plurality of securing points and secured to the ground; and
a zipper carried by the mesh material and operable to gain access to a location between the mesh material and the ground.

2. The securing net of claim 1 wherein the border material comprises:
an elastic material.

3. The securing net of claim 1 wherein the mesh material comprises:
an elastic material.

4. The securing net of claim 1 wherein the mesh material comprises a plurality of elastic cords.

5. The securing net of claim 1 wherein the mesh material further comprises:
a first plurality of parallel elastic cords; and
a second plurality of parallel elastic cords perpendicular to the first plurality of parallel elastic cords.

6. The securing net of claim 1 wherein the mesh material comprises an elastic material adapted to stretch at least fifty percent of its length in a longitudinal direction.

7. The securing net of claim 1 wherein the mesh material comprises an elastic material adapted to stretch fifty percent of its width in a transverse direction.

8. The securing net of claim 1 wherein at least a portion of the border material comprises an elastic material adapted to stretch fifty percent of its length in a longitudinal direction.

9. The securing net of claim 1 wherein the mesh material is non-absorbent.

10. The securing net of claim 1 further comprising:
an interior border material member secured to a first location on the border material and to a second location on an opposing location of the border material at a location other than at an edge of the mesh material.

11. The securing net of claim 10 wherein the interior border material member extends from a first midpoint of a first portion of the border material to a second midpoint of a second portion of the border material, which opposes the first midpoint of the first portion of the border material.

12. The securing net of claim 1 further comprising:
a mat secured to the border material.

13. The securing net of claim 12 wherein the mat is non-absorbent.

14. A securing net for personal items comprising:
a first mesh material having a perimeter;
a border material secured to an entirety of the perimeter of the mesh material;
a plurality of securing points carried by the border material; and
a mat secured to the border material.

15. The securing net of claim 14 further comprising:

an interior border material member secured to a first location on the border material and to a second location on an opposing location of the border material at a location other than at an edge of the mesh material.

16. The securing net of claim 14 wherein the interior border material member extends from a first midpoint of a first portion of the border material to a second midpoint of a second portion of the border material, which opposes the first midpoint of the first portion of the border material.

17. A securing net for personal items comprising:

an elastic, non-absorbent first mesh material adapted to stretch fifty percent of its length in a longitudinal direction, to stretch fifty percent of its width in a transverse direction, and having a perimeter, the mesh material comprising:

a first plurality of parallel elastic cords, and a second plurality of parallel elastic cords perpendicular to the first plurality of parallel elastic cords;

an elastic, non-absorbent border material adapted to stretch fifty percent of its length in a longitudinal direction and secured to an entirety of the perimeter of the mesh material;

a plurality of securing points secured to the border material;

a plurality of stakes wherein each of the plurality of stakes is adapted to be received by one of the plurality of securing points and secured to the ground;

a non-absorbent mat having a perimeter wherein at least a portion of the perimeter is secured to the border material;

a zipper carried by the mesh material and operable to gain access to a location between the mesh material and the mat; and an interior border material member secured to a first location at a first midpoint of a first side on the border material and to a second location at a second midpoint of a second side on the border material, opposing the first side at a location other than at an edge of the mesh material.

* * * * *